US006305255B1

(12) United States Patent
Wu

(10) Patent No.: US 6,305,255 B1
(45) Date of Patent: Oct. 23, 2001

(54) MODULAR SCREWDRIVER WITH FOUR USABLE WRENCH UNITS OF DIFFERENT SIZES

(76) Inventor: Chih-Ming Wu, No. 14, Lane 94, Shan-Hsien Rd., Shang-Ping Tsun, Shan-Lin Hsiang, Kaohsiung Hsien (TW)

( * ) Notice: Subject to any disclaimer, the term of this patent is extended or adjusted under 35 U.S.C. 154(b) by 0 days.

(21) Appl. No.: 09/624,045

(22) Filed: Jul. 24, 2000

(51) Int. Cl.[7] ..... B25B 23/00

(52) U.S. Cl. ..... 81/439; 81/490; 81/177.4; 81/437

(58) Field of Search ..... 81/437, 439, 177.4, 81/490, 124.4, 124.5

(56) References Cited

U.S. PATENT DOCUMENTS 2,453,901 * 11/1948 Gonsett et al. .
3,034,550 * 5/1962 Dahl .
4,300,607 * 11/1981 Mellinger .
5,881,615 * 3/1999 Dahl et al. .
5,964,132 * 10/1999 Chen .
6,029,549 * 2/2000 Baker .

* cited by examiner

*Primary Examiner*—James G. Smith
(74) *Attorney, Agent, or Firm*—Banner & Witcoff, Ltd.

(57) ABSTRACT

A modular screwdriver includes an elongated hollow handle, a first sleeve, a second sleeve, and a connecting rod. The first and second sleeves are mounted removably on two ends of the handle. The connecting rod extends through the handle, and can be locked releasably at a first position, where one of the first and second sleeves functions as a wrench, and a second position, where the other one of the first and second sleeves functions as a wrench. Each of the first and second sleeves has a central bore, which is formed therethrough and which has two hexagonal-cross-sectioned end portions of different sizes. All of the end portions of the central bores in the first and second sleeves are different from each other in size. Because either of the ends of each of the first and second sleeves can be mounted removably on the handle, each of the first and second sleeves can be inverted. As such, the screwdriver has four wrench units of different sizes.

6 Claims, 4 Drawing Sheets

MODULAR SCREWDRIVER WITH FOUR USABLE WRENCH UNITS OF DIFFERENT SIZES

BACKGROUND OF THE INVENTION

1. Field of the Invention

The invention relates to a screwdriver, more particularly to one with four usable wrench units.

2. Description of the Related Art

Referring to FIGS. 1 and 2, a conventional modular screwdriver 1 is shown to include an elongated hollow handle 11, a plurality of bits 15,16, a first sleeve 12, a second sleeve 13, and a connecting rod 14. The handle 11 has a hexagonal-cross-sectioned central bore 111 formed therethrough. The first sleeve 12 has a central bore 121 that is formed therethrough and that has a hexagonal cross-section. The second sleeve 13 has a central bore 131 that is formed therethrough and that has a hexagonal cross-section of a different size from the central bore 121 in the first sleeve 12. The connecting rod 14 extends axially and movably through the handle 11, and has first and second end portions 14',14" that extend respectively into the first and second sleeves 12,13. Each of the first and second end portions 14',14" of the connecting rod 14 has an end surface that is formed with a hexagonal-cross-sectioned bore 143,144. One of the bits 15,16 is disposed removably on the connecting rod 14. The first sleeve 12 is formed with an annular retaining slot 122. The first end portion 14' of the connecting rod 14 is formed with an annular first positioning groove 141 and an annular second positioning groove 142. The first positioning groove 141 is nearer to the second end portion 14" of the connecting rod 14 than the second positioning groove 142. A clip 123 extends through the retaining slot 122' and engages one of the first and second positioning grooves 141,142. Moreover, the connecting rod 14 is further formed with a hexagonal-cross-sectioned positioning portion 145 to engage fittingly in the central bore 111 in the handle 11.

Referring to FIG. 1, when the connecting rod 14 is located at a first position, the first end portion 14' extends through the first sleeve 12 so as to receive the bit 15 for functioning as a screwdriver to drive screws. The second end portion 14" extends into a middle portion of the second sleeve 13 so that the second sleeve 13 functions as a wrench.

Referring to FIG. 2, when the connecting rod 14 is located at a second position, the second portion 14" extends through the second sleeve 13 so as to receive the bit 16 for functioning as a screwdriver to drive screws. The first end portion 14' extends into an intermediate portion of the first sleeve 12 so that the first sleeve 12 functions as a wrench.

Accordingly, the conventional modular screwdriver can only provide two usable wrench units, thereby, resulting in limited usage thereof.

SUMMARY OF THE INVENTION

Therefore, the main object of the present invention is to provide a screwdriver with four usable wrench units which is capable of overcoming the aforesaid drawbacks commonly associated with the prior art.

According to the present invention, a screwdriver includes:

an elongated hollow handle having a central bore that is formed therethrough and that has first and second end portions;

a plurality of bits disposed removably on the handle;

a first retaining device;

a first sleeve having a central bore that is formed therethrough and that has two hexagonal-cross-sectioned end portions of different sizes, the first sleeve having two ends, one of which is mounted removably within the first end portion of the central bore in the handle by the first retaining device, the one of the ends of the first sleeve being capable of being removed forcibly from the handle so as to mount the other one of the ends of the first sleeve removably within the first end portion of the central bore in the handle by the first retaining device;

a second retaining device;

a second sleeve having a central bore that is formed therethrough and that has two hexagonal-cross-sectioned end portions of different sizes, one of which is mounted removably within the second end portion of the central bore in the handle by the second retaining device, the sizes of the end portions of the central bore in the second sleeve being different from those of the end portions of the central bore in the first sleeve, the one of the ends of the second sleeve being capable of being removed forcibly from the handle so as to mount the other one of the ends of the second sleeve removably within the second end portion of the central bore in the handle by the second retaining device;

a connecting rod extending axially and movably through the handle and having first and second end portions that extend respectively into the first and second sleeves, each of the first and second end portions of the connecting rod having an end surface that is formed with a hexagonal-cross-sectioned bore;

means for retaining the connecting rod on the handle; and means for locking the connecting rod releaseably at a first position, where the first end portion of the connecting rod extends to a position between the ends of the first sleeve so that the first sleeve functions as a wrench and where a portion of the second end portion of the connecting rod projects from the second sleeve so that the hexagonal-cross-sectioned bore in the second end portion of the connecting rod can receive one of the bits for functioning as a screwdriver, and a second position, where a portion of the first end portion of the connecting rod projects from the first sleeve and where the second end portion of the connecting rod extends to a position between the ends of the second sleeve so that the hexagonal-cross-sectioned bore in the first end portion of the connecting rod can receive one of the bits for functioning as a screwdriver and so that the second sleeve functions as a wrench.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
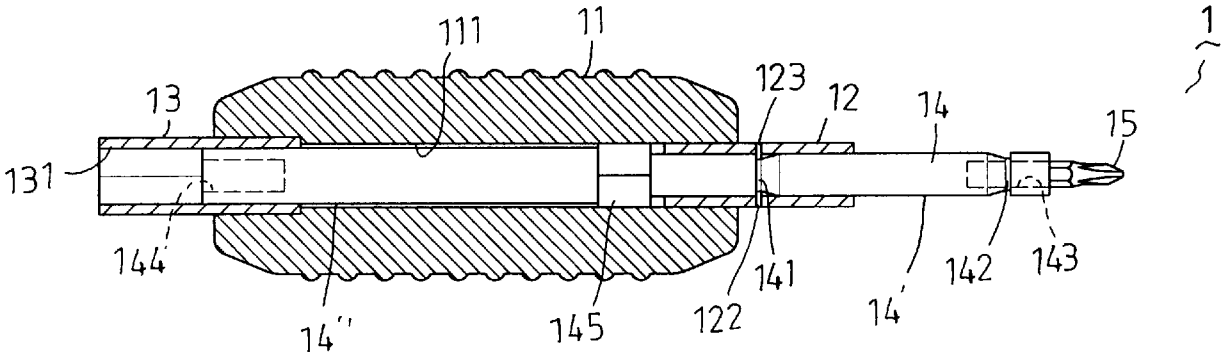
FIG. 1 PRIOR ART
FIG. 1 is a partly cross-sectional view of a conventional modular screwdriver in one use state.
Figure 2:
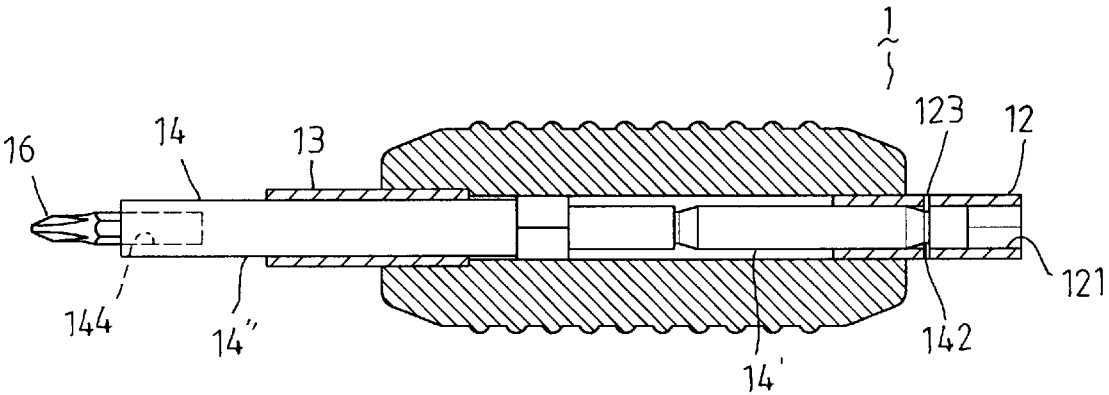
FIG. 2 PRIOR ART
FIG. 2 is a partly cross-sectional view of a conventional modular screwdriver in another use state.
Figure 3:
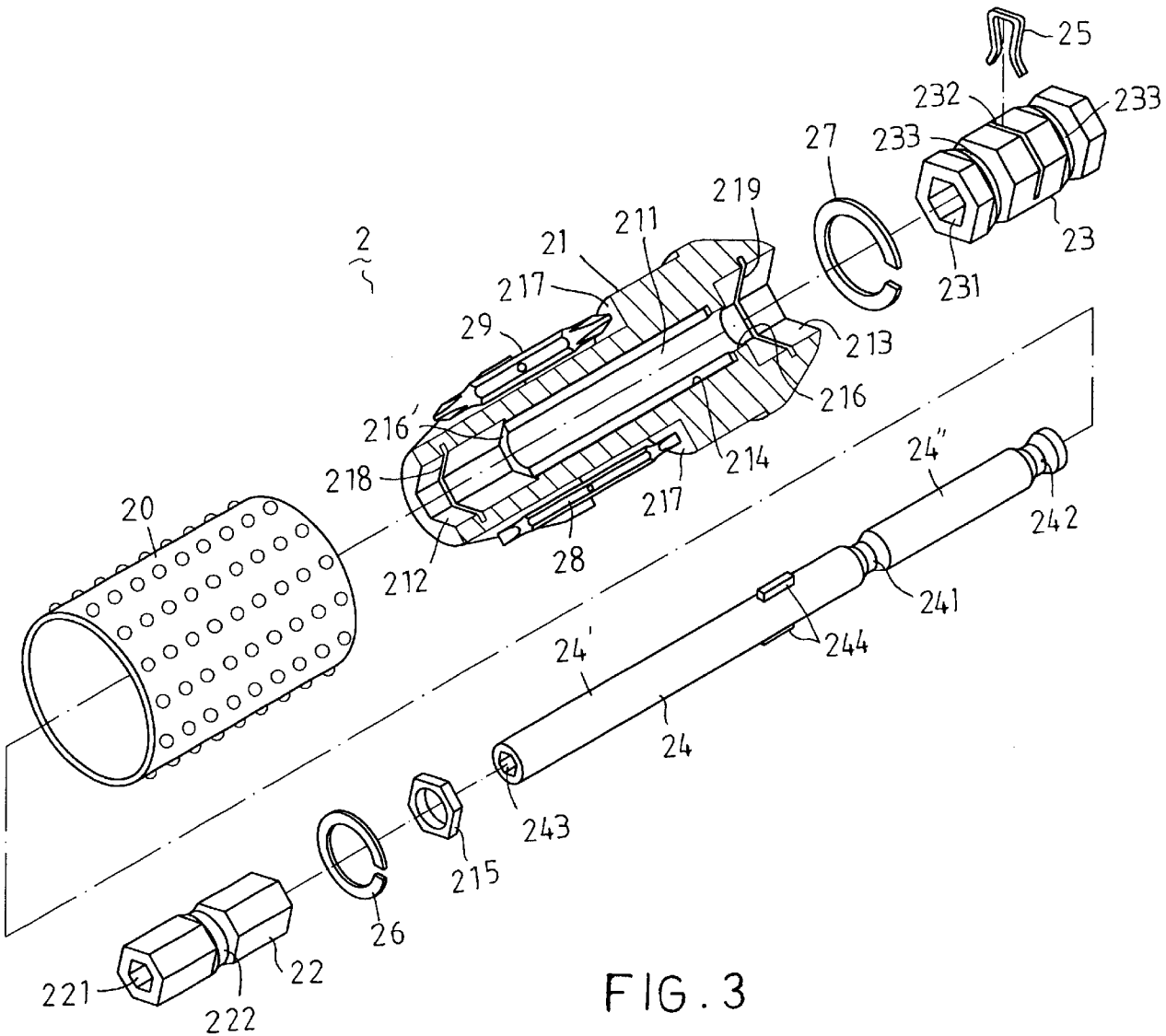
FIG. 3 is an exploded perspective view of the preferred embodiment of a screwdriver according to the present invention.
Figure 4:
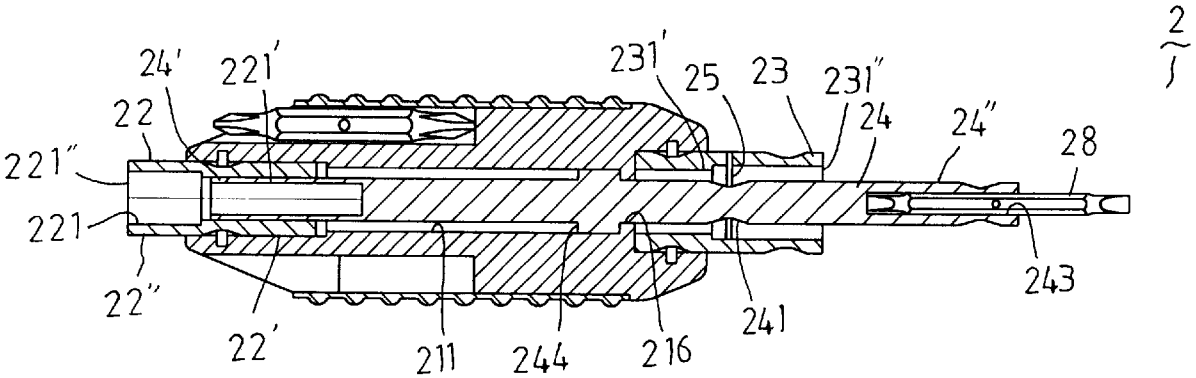
FIG. 4 is a cross-sectional view of the preferred embodiment in one use state.

Referring to FIGS. 3 and 4, the preferred embodiment of a screwdriver 2 according to the present invention is shown to include an elongated hollow handle 21, a plurality of bits 28,29, a first sleeve 22, a second sleeve 23, and a connecting rod 24. The handle 21 has a central bore 211 that is formed therethrough and that has first and second end portions 212, 213. The bits 28, 29 are disposed removably on the handle 21. The first sleeve 22 has a central bore 221 that is formed therethrough and that has two hexagonal-cross-sectioned end portions 221', 221" of different sizes.

Figure 6:
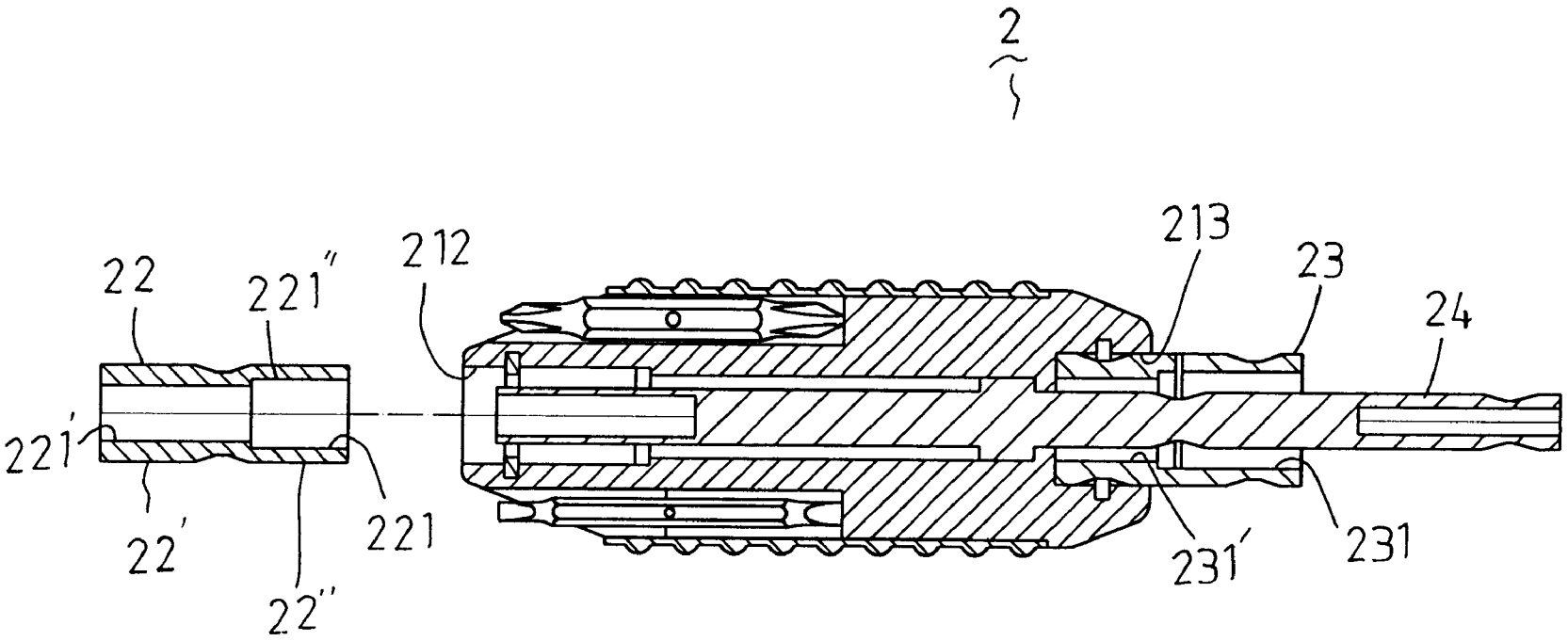
FIG. 6 is a cross-sectional view illustrating how a first sleeve of the preferred embodiment is inverted for another use.

The first sleeve 22 has a first end 22' which is mounted removably within the first end portion 212 of the central bore 211 in the handle 21 by a first retaining device. The first retaining device includes an annular first retaining groove 222 formed in an outer surface of a middle of the first sleeve 22, an annular first retaining slot 218 formed in an inner surface of the handle 21, and a C-shaped first retaining ring 26 disposed in the first end portion 212 of the central bore 211 in the handle 21 and engaging the first retaining groove 222 in the first sleeve 22 and the first retaining slot 218 in the handle 21. The first end 22' of the first sleeve 22 is capable of being removed forcibly from the handle 21 so as to mount a second end 22" of the first sleeve 22 removably within the first end portion 212 of the central bore 211 in the handle 21 by a first retaining device 1 as shown in FIG. 6. The second sleeve 23 has a central bore 231 that is formed therethrough and that has two hexagonal-cross-sectioned end portions 231', 231" of different sizes. A first end of the second sleeve 23 is mounted removably within the second end portion 213 of the central bore 211 in the handle 21 by the second retaining device. The sizes of the end portions 231', 231" of the central bore 231 in the second sleeve 23 are different from those of the end portions 221', 221" of the central bore 221 in the first sleeve 22. The second retaining device includes two annular second retaining grooves 233 formed in an outer surface of the second sleeve 23, and disposed adjacent to the ends of the second sleeve 23, an annular second retaining slot 219 formed in an inner surface of the handle 21, and a C-shaped second retaining ring 27 disposed in the second end portion 213 of the central bore 211 in the handle 21 and engaging one of the second retaining grooves 233 in the second sleeve 23 and the second retaining slot 219 in the handle 21. One end of the second sleeve 23 is capable of being removed forcibly from the handle 21 so as to mount a second end of the second sleeve 23 removably within the second end portion 213 of the central bore 211 in the handle 21 by the second retaining device. The connecting rod 24 extends axially and movably through the handle 21, and has first and second end portions 24', 24" that extend respectively into the first and second sleeves 22, 23. Each of the first and second end portions 24', 24" of the connecting rod 24 has an end surface that is formed with a hexagonal-cross-sectioned bore 243.

There is provided means for retaining the connecting rod 24 on the handle 21, which includes an inward flange 216 formed integrally in the handle 21, a shoulder 216' formed in the handle 21 and spaced apart from the inward flange 216 so as to define an axially extending slide slot 214 that is formed in an inner surface of the handle 21 between the inward flange 216 and the shoulder 216', two projections 244 extending integrally from two sides of the connecting rod 24 and engaging slidably the slide slot 214 in the handle 21, and a stop ring 215 that is press fitted within the first end portion 212 of the central bore 211 in the handle 21 and that abuts against the shoulder 216'. The stop ring 215 is sleeved movably on the connecting rod 24 for preventing removal of the projections 244 from the first end portion 212 of the central bore 211 in the handle 21. There is further provided means for locking the connecting rod releaseably at a first position shown in FIG. 4 and a second position shown in FIG. 5, which includes a positioning slot 232 formed through a wall of the second sleeve 23, an annular first positioning groove 241 formed in the second end portion 24" of the connecting rod 24, and an annular second positioning groove 242 formed in the second end portion 24" of the connecting rod 24. The first positioning groove 241 is nearer to the first end portion 24' of the connecting rod 24 than the second positioning groove 242. The locking means further includes a U-clip 25 extending through the positioning slot 232 in the second sleeve 23 and engaging one of the first and second positioning grooves 241, 242.

Referring to FIG. 4, when the connecting rod 24 is located at the first position, the U-clip 25 engages the first positioning groove 241. In this position 1 the first end portion 24' of the connecting rod 24 extends to a position between the ends of the first sleeve 22 so that the first sleeve 22 functions as a wrench. A portion of the second end portion 24" of the connecting rod 24 projects from the second sleeve 23 so that the hexagonal-cross-sectioned bore 243 in the second end portion 24" of the connecting rod 24 can receive one of the bits 28,29 (See FIG. 3) for functioning as a screwdriver.

Figure 5:
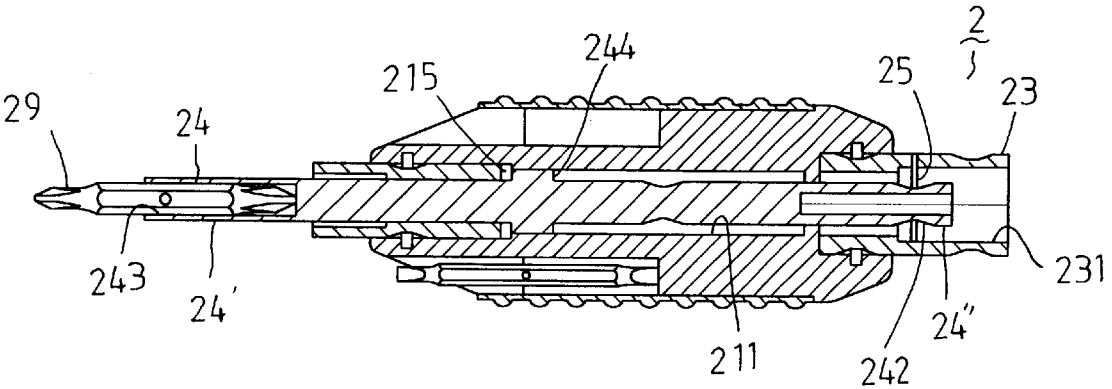
FIG. 5 is a cross-sectional view of the preferred embodiment in another use state.

Referring to FIG. 5, when the connecting rod 24 is located at the second position, the U-clip 25 engages the second positioning groove 242. In this position 1 a portion of the first end portion 24' of the connecting rod 24 projects from the first sleeve 22. The second end portion 24" of the connecting rod 24 extends to a position between the ends of the second sleeve 23 so that the hexagonal-cross-sectioned bore 243 in the first end portion 24' of the connecting rod 24 can receive one of the bits 28, 29 (see FIG. 3) for functioning as a screwdriver and so that the second sleeve 23 functions as a wrench.

Referring again to FIG. 3, the screwdriver of this embodiment has an outer surface that is formed with a plurality of bit storing cavities 217 for receiving the bits 28,29, respectively. A rubber sleeve 20 is disposed around the handle 21 for retaining the bits 28, 29 between the handle 21 and the rubber sleeve 20.

Therefore, the screwdriver according to the invention is provided with four usable wrench units, which are formed from the ends of the first and second sleeves 22, 23.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A screwdriver comprising:

an elongated hollow handle having a central bore that is formed therethrough and that has first and second end portions;

a plurality of bits disposed removably on the handle;

a first retaining device;

a first sleeve having a central bore that is formed therethrough and that has two hexagonal-cross-sectioned end portions of different sizes, the first sleeve having two ends, one of which is mounted removably within the first end portion of the central bore in the handle by the first retaining device, the one of the ends of the first sleeve being capable of being removed forcibly from the handle so as to mount the other one of the ends of the first sleeve removably within the first end portion of the central bore in the handle by the first retaining device;

a second retaining device;

a second sleeve having a central bore that is formed therethrough and that has two hexagonal-cross-sectioned end portions of different sizes, one of which is mounted removably within the second end portion of the central bore in the handle by the second retaining device, the sizes of the end portions of the central bore in the second sleeve being different from those of the end portions of the central bore in the first sleeve, the one of the ends of the second sleeve being capable of being removed forcibly from the handle so as to mount the other one of the ends of the second sleeve removably within the second end portion of the central bore in the handle by the second retaining device;

a connecting rod extending axially and movably through the handle and having first and second end portions that extend respectively into the first and second sleeves, each of the first and second end portions of the connecting rod having an end surface that is formed with a hexagonal-cross-sectioned bore;

means for retaining the connecting rod on the handle; and means for locking the connecting rod releaseably at a first position, where the first end portion of the connecting rod extends to a position between the ends of the first sleeve so that the first sleeve functions as a wrench and where a portion of the second end portion of the connecting rod projects from the second sleeve so that the hexagonal-cross-sectioned bore in the second end portion of the connecting rod can receive one of the bits for functioning as a screwdriver, and a second position, where a portion of the first end portion of the connecting rod projects from the first sleeve and where the second end portion of the connecting rod extends to a position between the ends of the second sleeve so that the hexagonal-cross-sectioned bore in the second end portion of the connecting rod can receive one of the bits for functioning as a screwdriver and so that the second sleeve functions as a wrench.

2. The screwdriver as claimed in claim 1, wherein the first retaining device includes:

an annular first retaining groove formed in an outer surface of the first sleeve;

an annular first retaining slot formed in an inner surface of the handle; and a C-shaped first retaining ring disposed in the first end portion of the central bore in the handle and engaging the first retaining groove in the first sleeve and the first retaining slot in the handle.

3. The screwdriver as claimed in claim 1, wherein the second retaining device includes:

two annular second retaining grooves formed in an outer surface of the second sleeve and disposed adjacent to the ends of the second sleeve;

an annular second retaining slot formed in an inner surface of the handle; and a C-shaped second retaining ring disposed in the second end portion of the central bore in the handle and engaging one of the second retaining grooves in the second sleeve and the second retaining slot in the handle.

4. The screwdriver as claimed in claim 1, wherein said means for retaining the connecting rod on the handle includes:

an inward flange formed integrally in the handle;

a shoulder formed in the handle and spaced apart from the inward flange so as to define an axially extending slide slot that is formed in an inner surface of the handle between the inward flange and the shoulder;

two projections extending integrally from two sides of the connecting rod and engaging slidably the slide slot in the handle; and a stop ring that is press fitted within the first end portion of the central bore in the handle and that abuts against the shoulder, the stop ring being sleeved movably on the connecting rod for preventing removal of the projections from the first end portion of the central bore in the handle.

5. The screwdriver as claimed in claim 1, wherein said means for locking the connecting rod releaseably at the first position and the second position includes:

a positioning slot formed through a wall of the second sleeve;

an annular first positioning groove formed in the second end portion of the connecting rod;

an annular second positioning groove formed in the second end portion of the connecting rod, the first positioning groove being nearer to the first end portion of the connecting rod than the second positioning groove; and a U-clip extending through the positioning slot in the second sleeve and engaging one of the first and second positioning grooves, said connecting rod being located at said first position when said U-clip engages said first positioning groove and at said second position when said U-clip engages said second positioning groove.

6. The screwdriver as claimed in claim 1, wherein the handle has an outer surface that is formed with a plurality of bit storing cavities for receiving the bits, respectively, the screwdriver further including a rubber sleeve that is disposed around the handle for retaining the bits between the handle and the rubber sleeve.

* * * * *